US005195569A

United States Patent [19]

Peterson et al.

[11] Patent Number: 5,195,569

[45] Date of Patent: Mar. 23, 1993

[54] CLOSED LOOP CONTROL SYSTEM FOR SHADE ASSEMBLY

[75] Inventors: James E. Peterson, Denver; Robert W. Collett, Arvada, both of Colo.

[73] Assignee: Daylighting, Inc., Denver, Colo.

[21] Appl. No.: 357,638

[22] Filed: May 26, 1989

Related U.S. Application Data

[62] Division of Ser. No. 37,716, Apr. 13, 1987, Pat. No. 4,852,627.

[51] Int. Cl.[5] ..... E06B 9/06

[52] U.S. Cl. ..... 160/84.1; 248/268

[58] Field of Search ..... 160/84.1, 324, 166.1, 160/9, 102, 169, 172, 178.1, 107, 279, 322; 248/264, 268

[56] References Cited

U.S. PATENT DOCUMENTS

| | | | |
|---|---|---|---|
| 1,133,360 | 3/1915 | Casper | 248/268 |
| 1,635,700 | 7/1927 | Bijelow | 248/268 |
| 1,748,734 | 2/1930 | Schroyer | 248/268 |
| 1,838,320 | 12/1931 | Moore | 248/268 X |

FOREIGN PATENT DOCUMENTS

| | | | |
|---|---|---|---|
| 13580 | of 1902 | United Kingdom | 248/268 |

*Primary Examiner*—Blair M. Johnson
*Attorney, Agent, or Firm*—John E. Reilly

[57] ABSTRACT

A fenestration control includes a single loop cord in association with guide members and a drive pulley built into a generally channel-shaped framework and is specifically designed for use with pleated or cell-type shades. The entire shade assembly is capable of being removably installed within window openings and the like and may be operated manually, or by single or dual motor drives depending upon the size and load requirements of the shade.

1 Claim, 7 Drawing Sheets

CLOSED LOOP CONTROL SYSTEM FOR SHADE ASSEMBLY

This application is a divisional application of Ser. No. 37,716, filed 13 Apr., 1987, now U.S. Pat. No. 4,852,627, for CLOSED LOOP CONTROL SYSTEM FOR SHADE ASSEMBLY, invented by James E. Peterson and Robert W. Collett.

SPECIFICATION

This invention relates to shade assemblies for windows, doors and the like; and more particularly relates to a novel and improved motorized, remote control system for pleated fabric or cell-type shades.

BACKGROUND AND FIELD OF THE INVENTION

Shades or blinds of the accordion type, such as those made of a pleated fabric or hexagonal cell structure are in increasingly widespread use particularly in acting as closures across skylights or clerestory windows installed in commercial and residential buildings. Such architectural elements provide natural sunlight as well as passive solar heating or ventilating to an occupied space. However, fenestration controls using the standard pleated or hexagonal cell-type shades have not been completely satisfactory for such out-of-reach windows. In the past, the fenestration controls employed have included a motorized system where the fabric or cords are wound upon a drum, a manual system where the shade is opened or closed by hand or through the use of a rod or pole, or merely to use a fixed-in-place shade that cannot be opened.

In the foregoing and other applications, it is important that the shade assembly be of lightweight, compact construction which requires the least number of parts, can be easily installed while being adjustable for different length openings and capable of automatically compensating for differences in tension on opposite sides of the shade or blind as well as to prevent overloading of the motor drive when the shade is driven into the closed position.

Of the various approaches taken in the past, U.S. Pat. No. 4,368,770 to T. Ulfhielm employs an electric motor and two gears to wind up a cable in retracting collapsible shades or panels. U.S. Pat. No. 4,212,341 to E. V. Fisher employs parallel cords on rollers above and below the blind itself, the cords being elastic in order to reduce any stress in the system. U.S. Pat. No. 4,202,395 to R. A. Heck et al also employs pulleys on parallel cords above and below the blind itself and provides for spring-loading to maintain a constant line tension. U.S. Pat. No. 3,646,877 to D. H. Ellis discloses a worm gear drive for a cable drum system, and similarly U.S. Pat. No. 3,576,206 to P. C. Trexler winds up parallel cords on a motorized drum, and stationary pulleys are mounted at the two bottom corners of the opening. Other patents of interest are U.S. Pat. No. 2,874,612 to S. N. F. Luboshez; U.S. Pat. No. 3,465,806 to E. M. Sulkes; U.S. Pat. No. 3,665,996 and U.S. Pat. No. 3,752,208 to F. D. Roberts.

SUMMARY OF THE INVENTION

It is an object of the present invention to provide for a novel and improved control system for shades or blinds which is greatly simplified in construction and requires a minimum number of parts in assembly and installation.

It is a further object of the present invention to provide for a novel and improved shade assembly which can be easily and removably installed across various different sizes and types of openings in a building but is particularly adaptable for use in acting as a remote controlled, adjustable closure across relatively inaccessible window openings, such as, skylights or clerestories.

It is yet another object of the present invention to provide for a shade assembly and control system therefor which will automatically compensate for differences in tension on opposite sides of the assembly, is readily adjustable for different length openings and is self-leveling.

It is a still further object of the present invention to provide for a novel and improved shade assembly and control system therefor which is conformable for use with single or double motor drives, depending upon size and drive requirements.

Yet another object of the present invention is to provide for a control system for shade or blind assemblies of the accordion type in which a single flexible cord can be formed into a continuous loop and which in combination with a unique pulley system can be motor driven from one or both sides and oriented for expansion or contraction vertically up or down as well as horizontally across an opening.

Additionally, it is an object of the present invention to provide for the unique cooperative disposition and mounting between a drive system and rails into a rigid framework for shade assemblies of the cell or accordion type.

In accordance with the present invention, a fenestration control has been devised for an adjustable shade assembly of the type in which outer, generally rectangular frame is installed in an opening in a building structure, a stationary rail being disposed along one end of the frame, a movable rail in parallel to the stationary rail and movable toward and away from an opposite end of the frame, there being a shade member secured to the movable rail and stationary rail for expansion and contraction in response to advancement of the movable rail toward and away from the opposite end of the frame. In a preferred form of control system, guide members are positioned at the four corners of the frame including a rotatable drive pulley and means resiliently mounting the guide members at least at one end of the frame, and an inelastic cord trained over the guide members including the drive pulley, the cord secured to opposite ends of the movable rail such that rotation of the drive pulley imparts movement to the cord in a direction advancing opposite ends of the rail in the same direction, and drive means serve to reversibly rotate the drive pulley in advancing the shade member and movable rail across the opening. The inelastic cord or cable is of a single length with free ends anchored together at one end of the movable rail, and the guide members are preferably defined by rollers journaled for rotation at the four corners of the frame. The frame is so constructed and arranged as to be capable of releasable mounting within an opening in a building structure by means of mounting brackets fastened in the building wall surrounding an opening in such a way as to align with notched portions on the exterior surface of the frame, each mounting bracket including a spring element biased for extension away from the surface to which it is attached for releasable insertion into a notched portion, the spring elements being yieldable in a direction normal to the side of the frame for movement into and away from a respective notched portion but non-yieldable in a direction parallel to side of the frame.

A novel and improved drive assembly is provided for flexibly but positively driving the shade via the inelastic cord. In addition, the drive system including drive pulley as well as the guide members are so designed as to be effectively integrated into the frame and, in the process of assembly, to facilitate assembly of the frame members into a unitary, rigid structure without the use of separate fastening elements, such as, screws or clips. The frame members are preferably constructed of channel-shaped rails so that the side rails and stationary motor rail can be constructed of the same cross-section, and the same is true of the movable or bottom rail and sill rail so as to greatly minimize fabrication of different parts.

A manual, single or double motor drive pulley system may be employed depending upon the size and load requirements of the shade assembly, and a stabilizer cable may be additionally employed where necessary to assist in guiding the movement of the shade between raised and lowered positions.

Other objects, advantages and features of the present invention will become more readily appreciated and understood when taken together with the following detailed description in conjunction with the accompanying drawings, in which:

DETAILED DESCRIPTION OF THE PREFERRED EMBODIMENT

Figure 1:
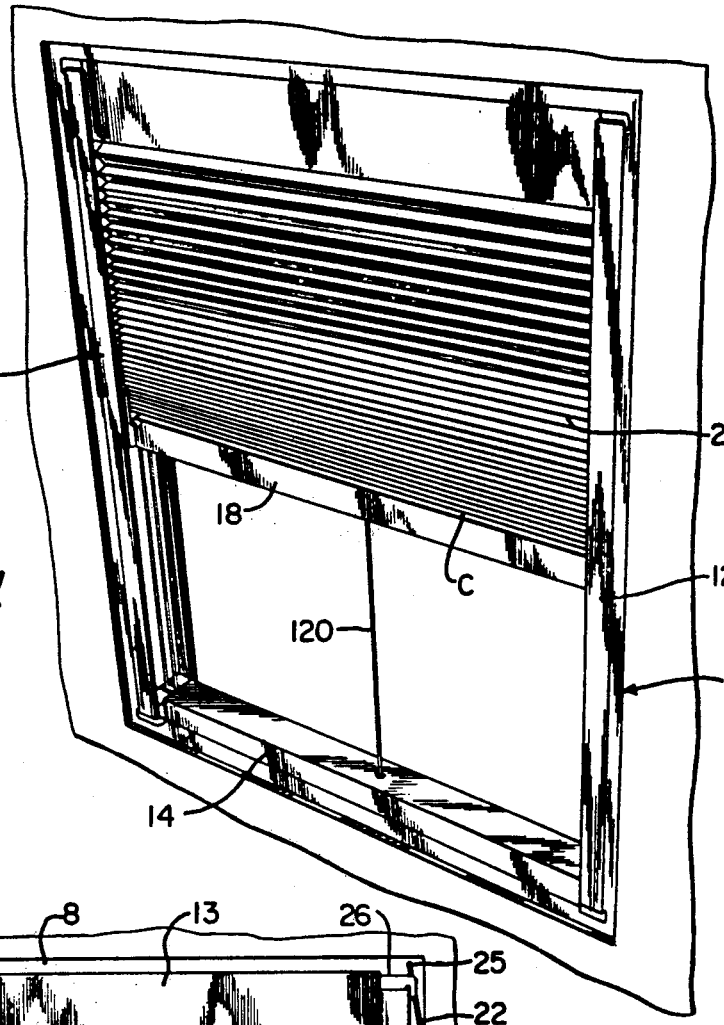
FIG. 1 is a somewhat perspective view illustrating the installation of a preferred form of shade assembly in accordance with the present invention.
Figure 2:
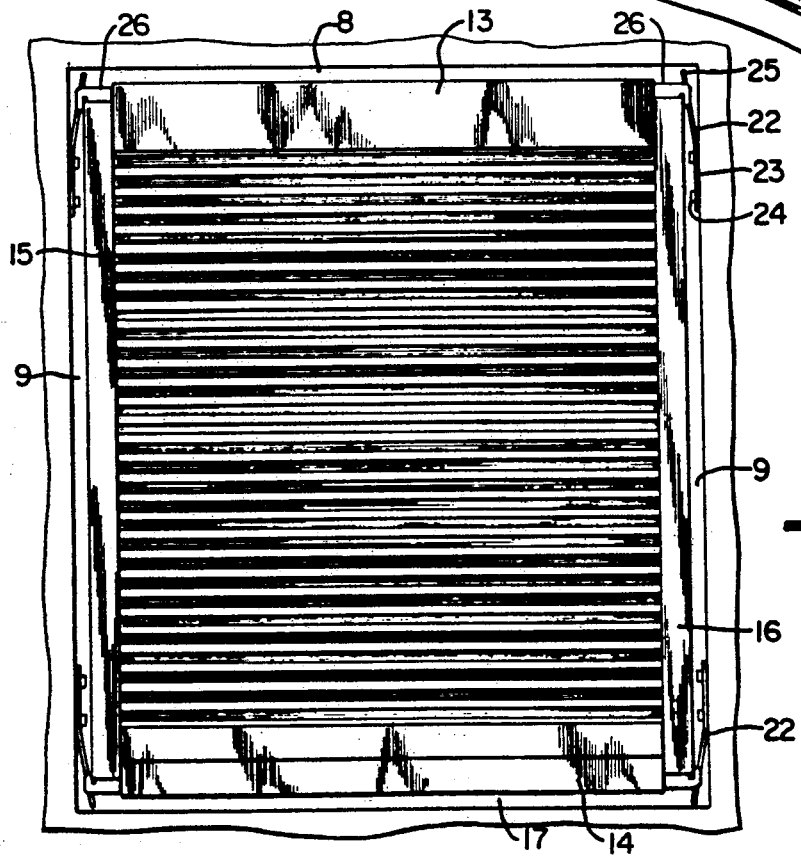
FIG. 2 is a front view in elevation of the preferred form of shade assembly installation shown in FIG. 1 with the fastening elements between the assembly and frame of a wall exposed.

Referring in more detail to the drawings, there is shown by way of illustrative example in FIGS. 1 and 2 a typical mounting of a preferred form of shade assembly 10 within an opening in a wall as defined by generally rectangular frame F. For example, the wall opening may be for a skylight or clerestory in which the window panel, not shown, is installed toward the exterior of the wall so that the shade assembly can be inserted into a generally rectangular recessed area surrounded by a sill 7, upper frame 8 and side frames 9 of the window frame F. The shade assembly 10 broadly comprises an outer, rigid, generally rectangular framework 12 including a motor or head rail 13, sill rail 14 and side channels or rails 15 and 16. A movable bottom rail or bar 18 is disposed for slidable advancement within the side channels or rails 15 and 16, and an accordion-type shade 20 has one end secured to the motor or head rail 13 and the opposite end secured to the movable bottom rail 18 with opposing lateral edges of the shade received within the side channels 15 and 16. For the purpose of illustration, and as best seen from FIGS. 4 and 5, the shade 20 is comprised of interconnected, hexagonal cell elements C which are capable of being tightly contracted together in response to raising or movement of the bottom rail 18 toward the head rail 13, for example, as shown in the partially raised position in FIG. 1; or can be expanded in response to movement of the rail 18 into abutting relation to the sill rail 14, as shown in the fully closed position of FIG. 2. In this relation, while the shade assembly is illustrated in a typical orientation in a vertical wall opening with the head rail 13 mounted at the upper end of the opening, it will become evident that, depending upon the desired installation, the orientation of the assembly may be reversed or modified for expansion of the shade 20 either in an upward or downward direction or in a horizontal direction across a window or door frame opening either to partially or fully cover the opening.

Figure 8:
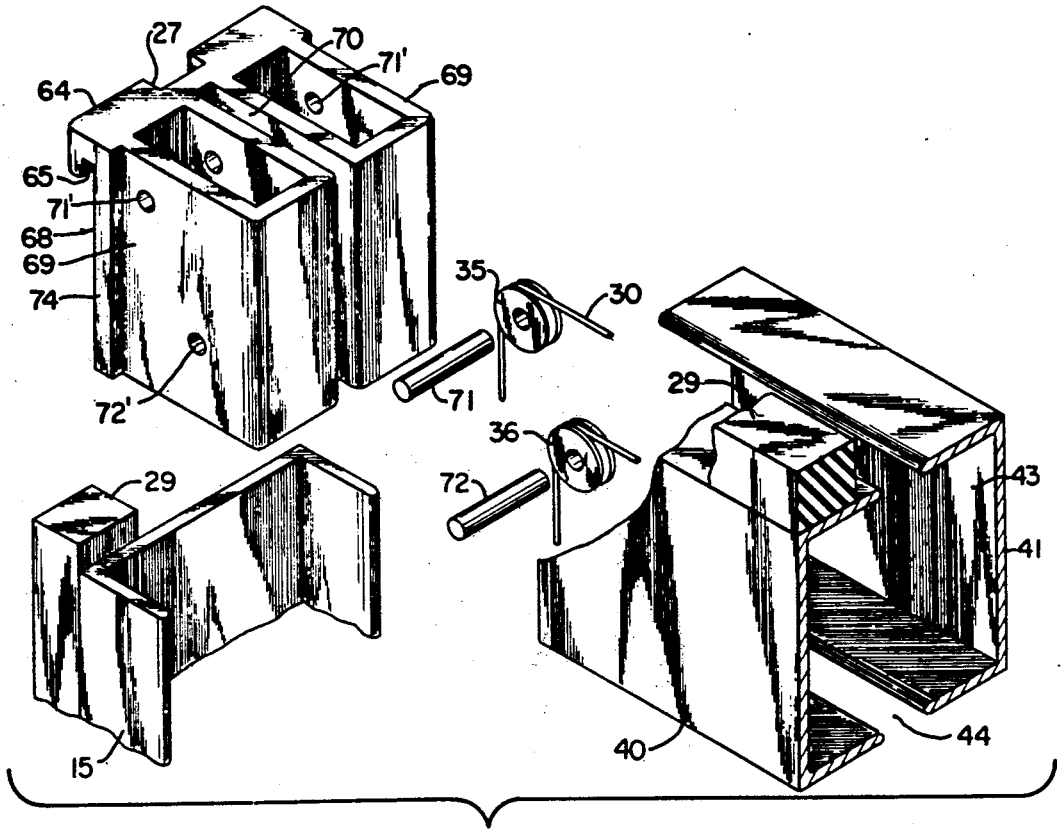
FIG. 8 is an exploded view of another one of the guide members of the shade assembly of the present invention.
Figure 10:
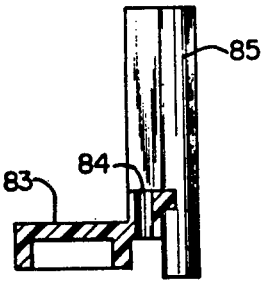
FIG. 10 is a cross-sectional view taken about lines 10—10 of FIG. 9.

As further noted in FIGS. 1 and 2, the shade assembly 10 of the present invention is designed in the preferred form for removable installation within the frame F by the simple expedient of mounting brackets or spring clips 22 at the four corners of the frame F. Specifically, each clip 22 takes the form of a leaf spring having a flat or anchored end portion 23 attached by suitable fasteners 24 to inner facing surfaces of side frame 9 with inwardly sprung or bent spring portions 25 having flat end portion 25' angled inwardly and away from the anchored end 23 toward the four corners of the frame 12. Opposite ends of the head rail 13 and sill rail 14 include notched portions 26, each having a notch or groove 27, as shown in FIG. 8, of generally rectangular cross-sectional configuration with an inner flat surface 27' and opposite sides 28, in confronting relation to a bent end 25 of a spring clip 22 to releasably receive the flat end portion 25' when the frame 12 is inserted into the window opening. In this way, the bent spring portions 25 are yieldable in a direction normal to the side edge of the frame for movement into and away from a respective groove 27 but are not yieldable in a direction parallel to the side edge of the frame 12. In order to install the assembly 10, all that is required is to slide one end of the frame into the opening until the upper bent ends 25 are aligned with the upper notched portions 27. The bent portions 25 at the lower end of the opening are sprung outwardly until the lower notched portions can be moved into alignment with the clips 22 whereupon releasing the lower spring ends 25 the flat end portion 25' will advance into engagement with the inner surface 27' of the associated notched portions 27 and be retained by the sides 28 so as to securely but releasably lock the shade assembly in place. Insulating foam strips 29 around the frame 12 occupy the space or gap between the window opening and the shade assembly 10. Installation in the manner described greatly facilitates removal of the frame 12 for the purpose of adjustment or servicing as desired, and this is accomplished by inserting any conventional type of a prying tool past the foam 29 and between the bent ends 25 and notched portions 27 at the lower end of the assembly to release the bent ends 25 away from the notched portions 27 and remove the entire frame or shade assembly 10 from the opening. Of course, the spring clips 22 and respective notched portions 25 may be suitably mounted between the frame members 7 and 8 and confronting surfaces of the sill rail 14 and head rail 13, and their spacing and number may be suitably varied according to the size of the opening and of the shade assembly to result in the most secure but releasable installation.

Figure 3:
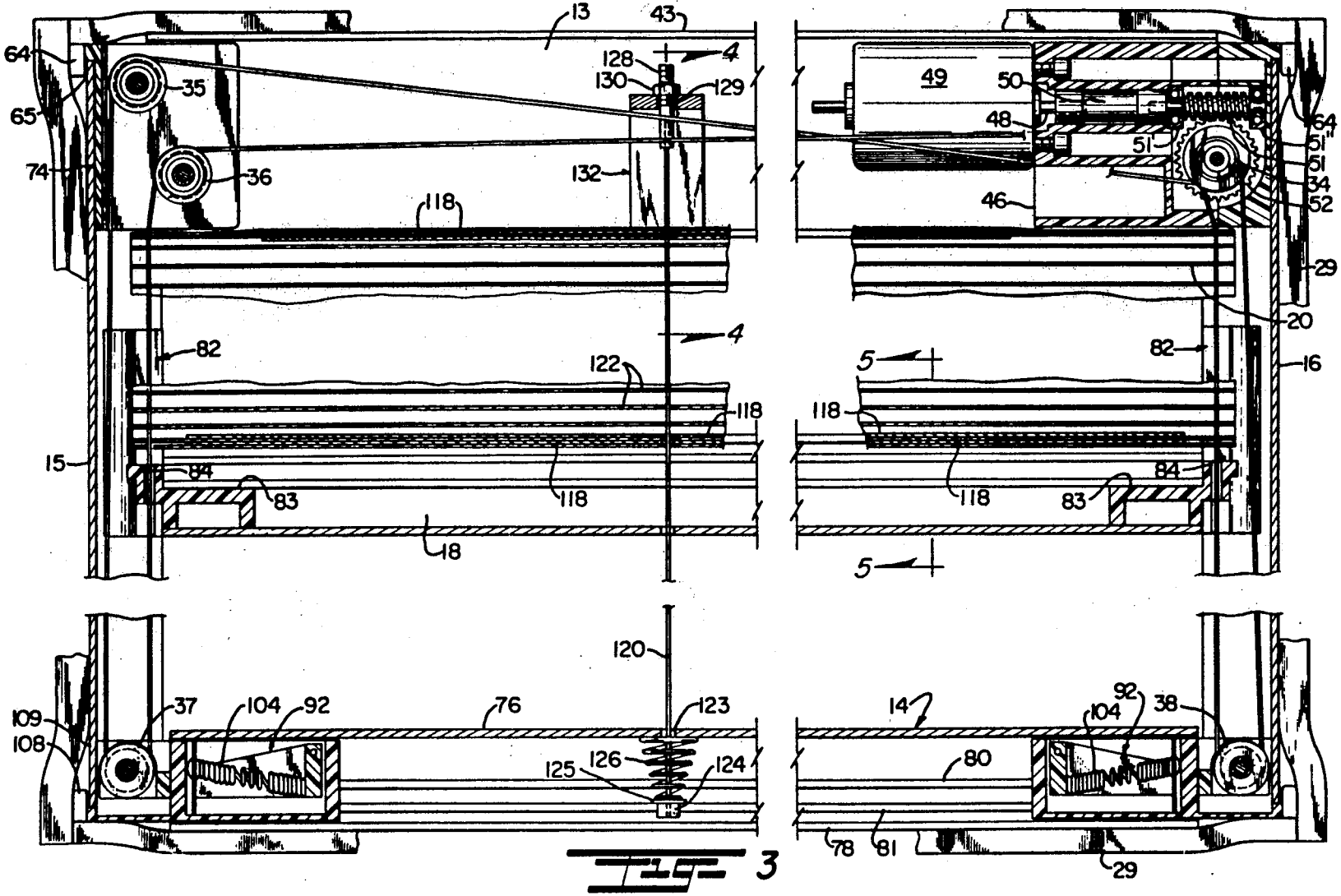
FIG. 3 is a front view, partially in section, of a preferred form of shade assembly and control system therefor.
Figure 13:
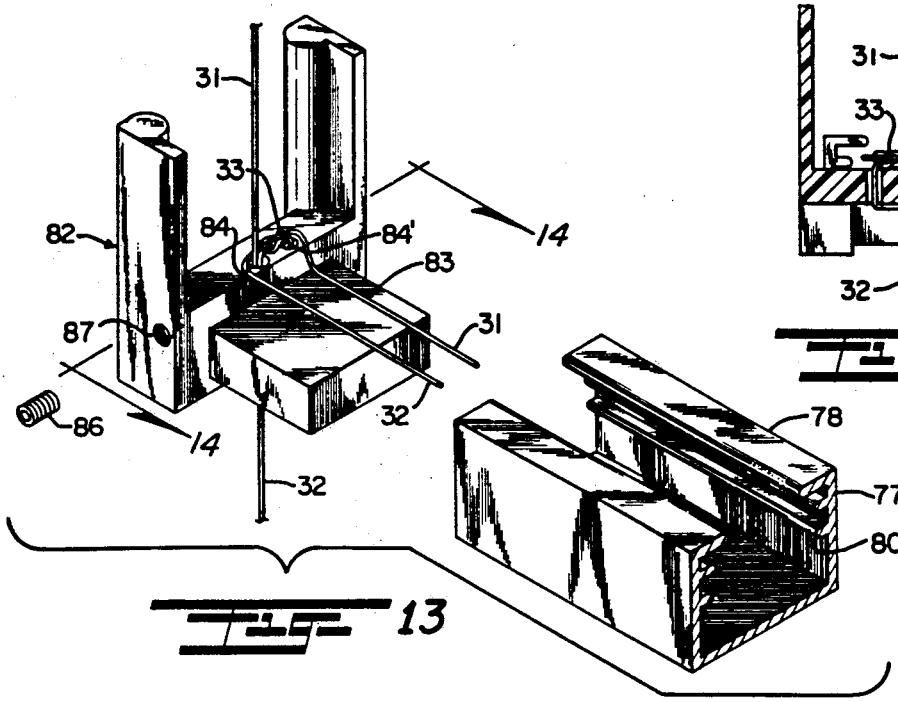
FIG. 13 is an exploded view illustrating attachment of the free ends of the cord employed in expansion and contraction of the shade assembly.
Figure 14:
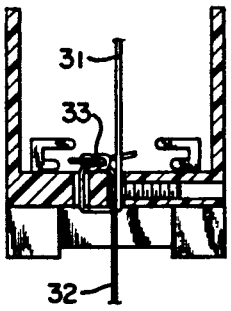
FIG. 14 is an end view of the assembled attachment of the free ends of the cord.

Preliminary to a more detailed description of the construction of the frame 12, an important feature of the present invention resides in the shade or fenestration control, commonly termed a closure operator, for the shade 20. As illustrated in FIG. 3, 13 and 14 a continuous loop system has been devised in the form of a single inelastic cord or cable 30 having free ends 31 and 32 knotted or tied together as at 33, and guide members for the cord 30 are positioned at each of the four corners of the frame 12, there being a first guide member in the form of a motor drive pulley 34, a second guide member defined by roller 35, a third guide member defined by roller 36, and fourth and fifth guide members defined by spring-loaded rollers or pulleys 37 and 38. In the preferred form, guide members 34 and 35 are positioned at opposite ends of the head rail 13, and the guide member 36 is disposed in adjacent but inwardly spaced and slightly offset relation to the guide member 35 at the one end of the head rail. In turn, the spring-loaded guide members 37 and 38 are stationed at opposite ends of the sill rail 14. The cord 30 is formed into a continuous loop by starting at one end 32 and passing downwardly around the lower end of spring-loaded pulley 37, then upwardly around the outside of that pulley 37 to the outside of upper guide member 35 where it is trained over the outside of that guide member and passed through the head rail. The cord 30 is wrapped a plurality of times around the guide member or drive member 34, then directed downwardly through aligned openings in the shade 20 and passed around the inside of the guide member 38, then upwardly from the outside of the guide member 38 to the outside of the drive pulley 34 where it is once again wrapped a plurality of times followed by extension around the outside of the guide member 36, and finally is passed downwardly once again through the opposite end of the shade 20 to terminate in the upper free end 31. The precise manner and means of securing the free ends 31 and 32 will be hereinafter described.

Figures 11, 12:
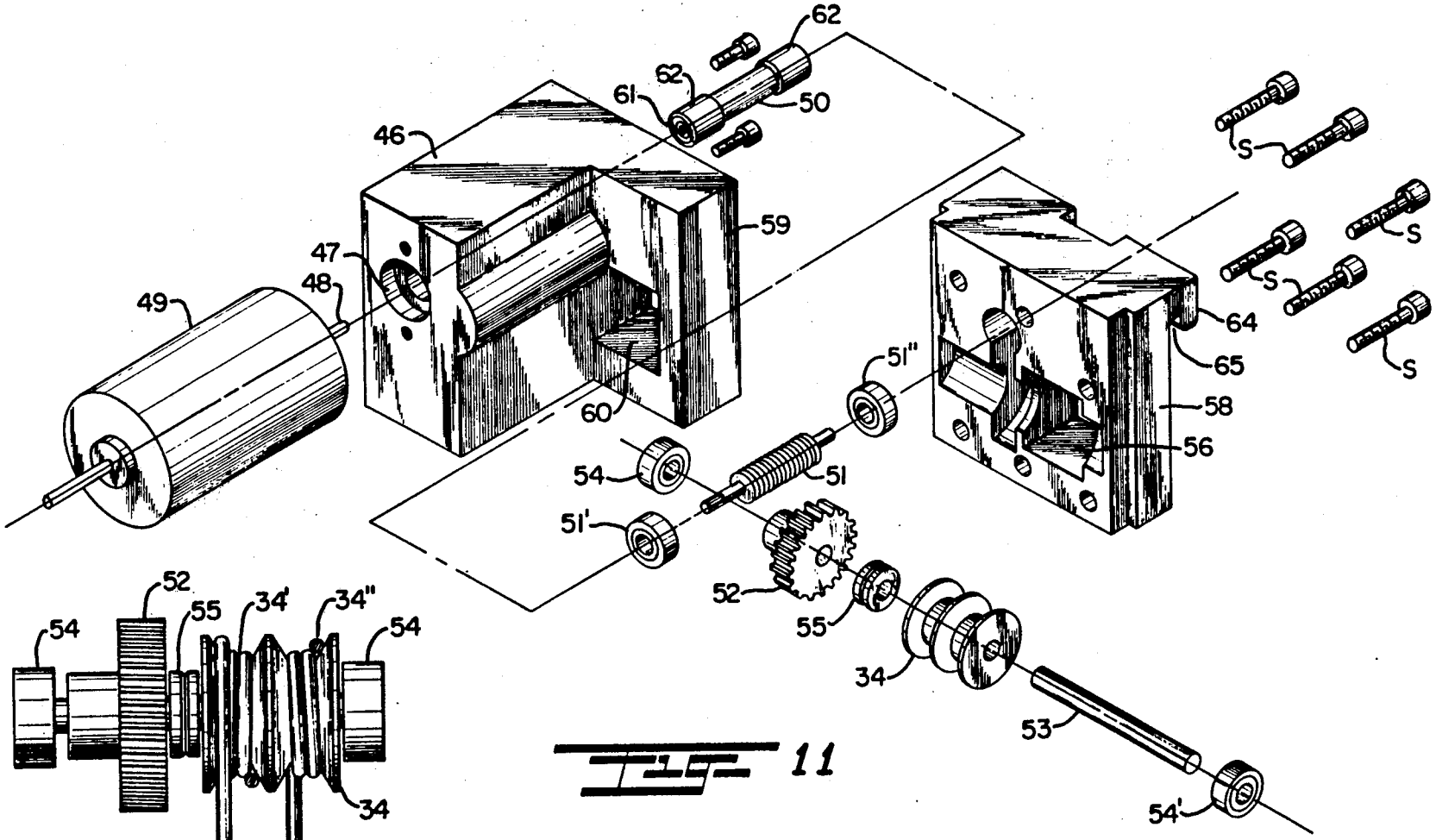
FIG. 11 is an exploded view of a preferred form of motor drive employed in the shade assembly of the present invention.
FIG. 12 is an enlarged view in more detail of the assembled motor drive.

Now referring in more detail to the construction of the frame assembly 12, the head rail 13, as shown in FIGS. 8 and 11, has a pair of channel-shaped members 40 and 41 positioned with their open ends in horizontally spaced, facing relation to one another so as to define upper and lower intermediate slots 43 and 44. Essentially, therefore, the head rail is in the form of an elongated hollow rectangular tube of a length to substantially traverse the length of the upper frame portion 8 of the opening. As will become more apparent, the head rail alternately may be constructed of a unitary member of generally rectangular cross-section with a single longitudinal slot 44 extending throughout its length for the purpose of securing the upper end of the shade 20; however, by forming two channel-shaped members as described which correspond to the side rails 16 reduces the number of extrusions required in the construction of the shade assembly. The head rail members 40 and 41 are assembled together with a motor mounting block 46 at one end of the rail members, the block 46 having a bore 47 to receive a drive shaft 48 of motor 49. The drive shaft 48 is inserted into one end of a flexible drive coupling 50 which passes through the bore 47, and the opposite end of the coupling 50 is drivingly connected to a knurled end of worm 51, the latter intermeshingly engaging a worm gear 52. As best seen from FIG. 3, the worm 51 is supported by bearings 51' at opposite ends thereof. In turn, the worm gear 52 is assembled on a common shaft 53 along with the pulley 34 which includes double grooves 34' and 34" for the successive wraps of the cord 30 as previously described. Bearings 54 and 54' are disposed at opposite ends of the shaft 53, and an oil seal 55 is interposed between the gear 52 and pulley 34 to prevent the migration of oil from the worm gear 52 to the motor drive pulley 34 along the common shaft 53. In assembled relation, the gear 52 and pulley 34 are mounted in a cavity 56 of a generally rectangular rail block portion 58, the latter affixed to the mounting block 46 by suitable fastener screws S so that the portion 58 is disposed in flush relation to a flat end surface 59 of the block 46 and with the gear 52 and pulley 34 aligned with an opening 60 in the block 46.

The coupling 50 is preferably constructed of a rugged but flexible material, such as one of the commercially available urethanes and has thin-walled interior and exterior metal collars 61 and 62 at opposite ends thereof. Preferably, one end of the coupling is affixed to the motor drive shaft 48 by a suitable bonding agent or adhesive, and the other end is pressfit over the knurled end of the worm 51 to effect a positive drive between the drive shaft and worm, the urethane coupling affording some flexibility or yield in the drive while being capable of transmitting torque between the drive shaft and pulley 34 via the worm 51 and worm gear 52. The motor rail block 58 includes an overhang or projection 64 in which is formed the notched portion 27 as earlier described together with a downwardly directed hook end or slot 65 to receive an end of the side rail 16.

Referring to FIGS. 3 and 8, the guide members or follower pulleys 35 and 36 are mounted in a common pulley block 68 at the opposite end of the head rail 13 to that of the motor mounting block 46. Broadly, the block 68 is constructed of bifurcated or divided hollow portions 69 separated by a common vertical gap or passage 70. Each of the pulleys 35 and 36 is journaled on a shaft 71 and 72 in aligned openings 71' and 72', respectively, through adjacent sidewalls of the portions 69. A hook end portion 74 of the block abuts the opposite end of the head rail 13 and includes an overhang 64 with notched portion 27 and slot 65 for insertion of the upper end of a side rail 15 as in the opposite end portion 58 as previously described.

Figure 5:
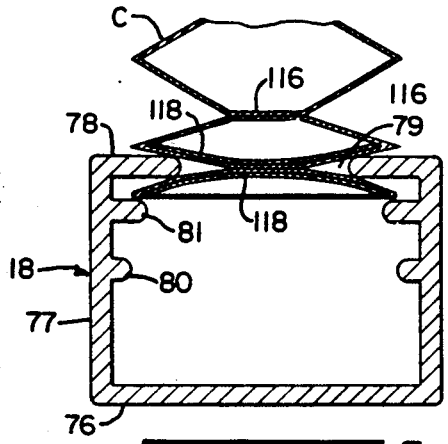
FIG. 5 is a cross-sectional view taken about lines 5—5 of FIG. 3.

As illustrated in FIGS. 3 and 5, the bottom rail 18 is of elongated, generally channel-shaped configuration having a bottom wall 76, opposite vertical sidewalls 77 and upper spaced wall portions 78 which form a common slot 79 therebetween for insertion of a cell C of the shade member 20. Internal, vertically spaced, horizontally extending ribs 80 and 81 extend inwardly from the sidewalls 77 in aligned relation to one another for a purpose to be later described. As further seen from FIG. 9, an end cap 82 includes a tongue 83 for close-fitting insertion into the end of the rail 18 between the bottom wall 76 and lower ribs 80. A central opening 84 in the guide block 82 is provided for insertion of the inner stretch of cord running downwardly from the motor drive pulley 34 to the lower guide member 38, and the outer stretch of the cord 30 from the guide member 38 extends vertically between the drive pulley 34 and lower guide member 38 externally of the end cap 82. Vertical extensions 85 on opposite sides of the cap 82 function as guide members for the rail 18 in advancing along the side rails 15 and 16, and a lock screw 86 is inserted through a threaded bore 87 into engagement with the cord 30 to secure the cap 82 and attached rail 18 to the cord 30 so as to follow vertical movement of the cord in response to rotation of the motor drive pulley 34.

Figure 9:
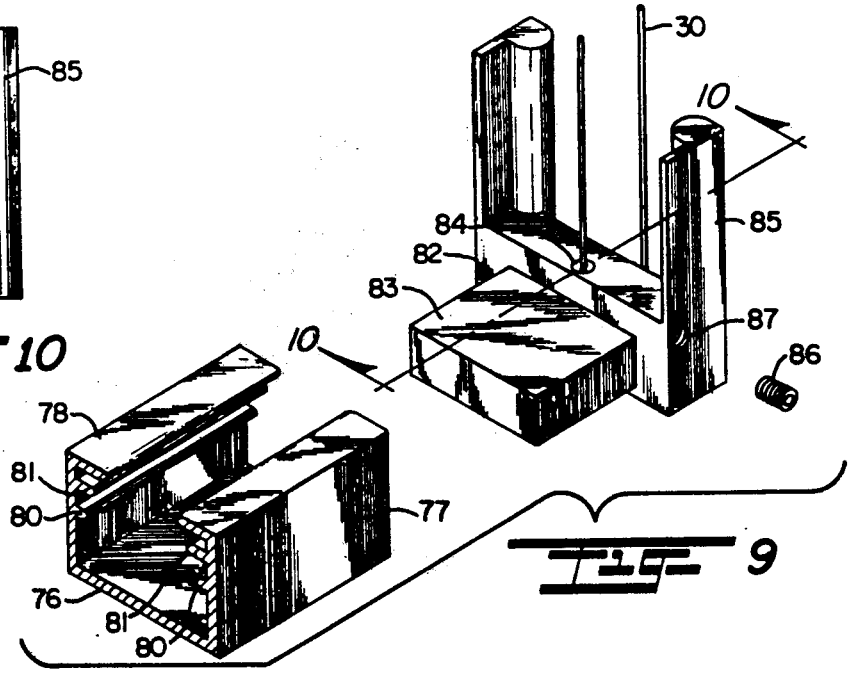
FIG. 9 is an exploded view of the interconnection between the bottom rail and end cap of the shade assembly of the present invention.

Referring to FIGS. 13 and 14, a corresponding guide block 82 is positioned at the opposite end of the movable rail 18 to that illustrated in FIG. 9, and like parts are correspondingly enumerated. Preferably, however, the guide block 82 of FIGS. 13 and 14 includes an additional bore 84' in closely spaced parallel relation to the bore 84 in order to facilitate tying of the free ends 31 and 32 and in a manner such that any tension imparted to the ends 31 and 32 is absorbed by the cap 82. Each end 31 and 32 is passed in opposite directions through the bore 84, then cable end 31 is looped through the auxiliary bore 84' and tied off as at 33 snugly against the upper surface of the block. The remaining or excess material of the cord ends 31 and 32 is then tucked into the bottom rail above the tongue 83. Again, a lock screw 86 is inserted through a threaded bore 87 into engagement with the cord ends 31 and 32. For this reason, it is not necessary to tie the ends 31 and 32 if not desired but to rely solely on the locking screw 86.

Figure 6:
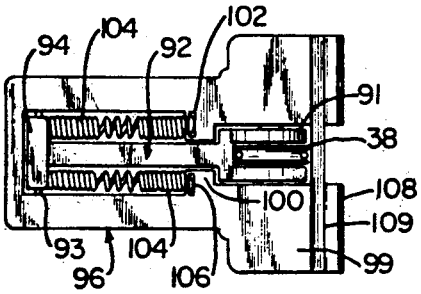
FIG. 6 is a top plan view of one of the guide members employed in the shade assembly of the present invention.
Figure 7:
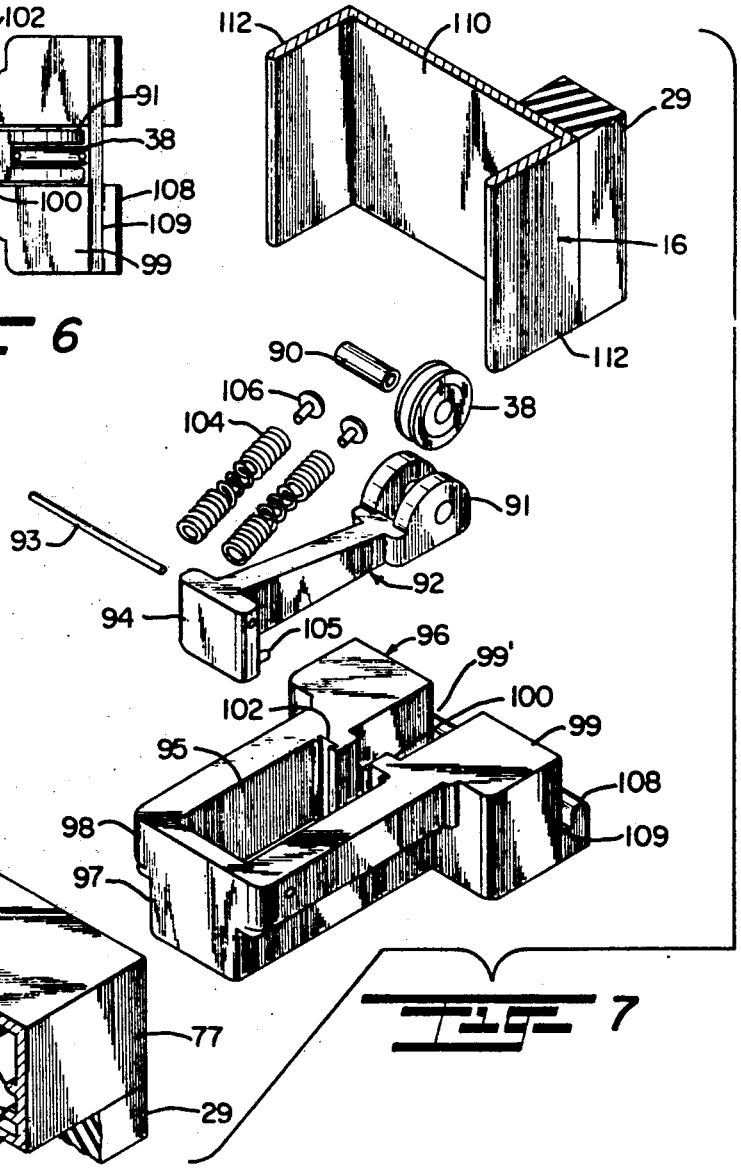
FIG. 7 is an exploded view of the guide member illustrated in FIG. 6.

The spring-loaded guide members 37 and 38 are pivotally mounted at opposite ends of the sill rail 14 in the manner illustrated in FIGS. 3, 6 and 7. The sill rail 14 is an elongated, channel-shaped member corresponding in cross-section to the bottom rail 18 and like parts are correspondingly enumerated. The sill rail is of the same length as the bottom rail 18 and, as shown, is reversed in mounting so that the slotted portion 79 is at the bottom of the rail. Each guide member 37 and 38 is in the form of a follower wheel or pulley and is of corresponding construction; thus a description of the mounting of the guide member 38 will apply equally to that of the guide member 37 and only the guide member 38 is illustrated in detail in FIGS. 6 and 7. The guide 38 is journaled on a shaft 90 at the free end 91 of a rocker arm 92. The opposite end 94 of the rocker arm is pivotal about a pin 93 at one end of a cavity 95 formed in a support block 96. The block 96 is of elongated, generally T-shaped cross-sectional configuration having a stem portion 97 of reduced width with respect to an outer broadened portion 98. Thus, when inserted into the end of the sill rail 14, the reduced portion 97 will clear the inner rib members 80 and 81, and the widened portion 98 is dimensioned to fit snugly between the ribs 80 and upper wall surface 76. The support block 96 terminates in a split end portion 99 which abuts the end of the sill rail 14 with a central gap 99' forming a continuation of the cavity 95 and which is interrupted by transverse ribs 100. The ribs 100 at the endwwall of the cavity 95 are provided with guide slots 102 facing the pivotal end of the cavity.

In assembled relation, the rocker arm 92 is aligned with the gap 99', and coiled compression spring elements 104 extend along opposite sides of the rocker arm within the cavity 95 with one end of each spring positioned on a stop element 105 at the pivotal end of the cavity. The opposite end of each spring 104 has a button head rivet 106 which is retained by and fixed in one of the slots 102 of a rib 100. Each of the end portions 99 has an overhang 108 at its lower end with an upwardly directed notched portion 109 in facing aligned relation to one of the notched portions 65 on the motor rail block 58 and pulley block 69. Accordingly, each of the notched portions 109 is aligned to receive the lower end of a channel rail 15 or 16. The guide members 37 and 38 in turn are positioned beyond the ends of the sill rail 14 so as to be free to pivot or move upwardly into the lower ends of the side rails 15 and 16 against the urging of their spring members 104 when sufficient tension is applied to the cord 30. As seen, upward pivotal or swinging movement of the guide members 37 and 38 is limited by advancement of the rocker arms 92 into engagement with the upper walls of the sill rail 14.

Each of the side rail members 15 and 16 is constructed of a channel of U-shaped cross-sectional configuration having an end wall 110 and spaced sidewalls 112. With respect to each rail 15 and 16, opposite ends of the end wall 110 are connected in snap-fit relation to the upper and lower notched portions 65 and 109 on opposite sides of the frame. In connected relation, the sidewalls 112 at the upper ends of the rails are disposed in close-fitting, overlapping relation to the end walls of the channel members 40 and 41 comprising the head rail 13. The lower ends of the side rails similarly have sidewalls 112 overlapping the sides of the end portion 96. In this way, the side rails 15 and 16 rigidify the entire structure into a rectangular frame without necessity of screws or other fastening elements. At the same time, the side rails 15 and 16 are of the same cross-sectional size as the channels 40 and 41 which make up the head rail 13 and therefore can be formed out of the same extrusion.

The shade 20 has opposite ends projecting into the interior of the side rails 15 and 16 with the vertically extending track members 85 on the end caps 82 sliding along the inner surfaces of the sidewalls 112 so as to maintain the proper attitude of the bottom rail 18 in its movement vertically along the side rails. The shade 20, for the purpose of illustration in the preferred form, is a conventional hexagonal cell structure composed of a fabric material and with mutually opposed sides 116 sealed to confronting sides of the next adjacent cells. The unattached sides of the six-sided cell elements are free to undergo considerable expansion and contraction as the shade is raised or lowered and, as a result, can form a complete barrier across an opening while admitting sunlight therethrough.

Figure 4:
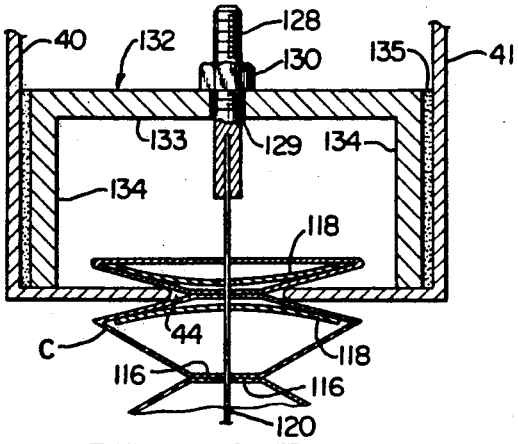
FIG. 4 is a cross-sectional view taken about lines 4—4 of FIG. 3.

As shown in FIGS. 4 and 5, a novel form of attachment is provided for opposite upper and lower ends of the shade 20. As illustrated, the uppermost and lowermost cell elements are inserted into the slots 44 and 79 of the head rail 13 and bottom rail 18, respectively, and are retained therein by endwise insertion of slats 118. Preferably, one slat 118 is inserted into the cell within the hollow interior of each rail 13 and 18 and a second slot is inserted endwise into the next adjacent or connected cell. Each slat 118 is preferably of concave-convex cross-sectional configuration, and adjacent pairs of slats are disposed with their convex surfaces in facing relation to one another so as to mutually reinforce the endmost pairs of cells C. The slats may be suitably composed of a lightweight aluminum material which will have some limited flexibility but possess sufficient strength to securely retain the cells within the rails 13 and 18 as described.

As illustrated in FIGS. 1 to 4, a stabilizer cable assembly for the shade 20 comprises an elongated slender cable 120 extending intermediately between opposite side edges of the shade and extends through vertically aligned openings 122 in the cells C of the shade. The lower extremity of the cable 120 extends through a bore 123 in the upper end of the sill rail 14 and has a swaged cable fitting 124 which in the extended or lowered position of the shade bears against a washer 125 at the lower tapered end of a conical spring 126. The upper enlarged end of the spring 126 bears against the underside of the wall 76 of the rail 14. In turn, the upper extremity of the cable 120 terminates in an enlarged fitting or sleeve 128 which is swaged onto the end of the cable. The upper end of the fitting 128 is externally threaded to receive a nut 130, the upper end of the fitting extending upwardly through a bore 129 in the closed end 133 of generally U-shaped bracket 132. The closed end 133 of the bracket 132 traverses the width of the rail 13, and sidewalls 134 of the bracket 132 extend downwardly from the closed end 133 in closely spaced, parallel relation to the sides of the rail 13. Double-faced, adhesive strips 135 are interposed between the sidewalls 134 and abutting surfaces of the sides of the head rail 13 in order to secure the head rail to the bracket and prevent the sides 40 and 41 of the head rail 13 from spreading apart under the weight of the shade 20. The nut 130 is threaded onto the upper end of the fitting 128 so as to bear against the top surface of the closed end 133 of the bracket 132 whereby to establish the desired degree of tension in the cable assembly. In addition, double-faced adhesive strips may be interposed between the blocks 46 and 68 at opposite ends of the head rail 13 and the sides 40 and 41 of the rail 13 to discourage any tendency of the rail 13 to spread apart or enlarge at the slotted opening 44 under the weight of the shade 20.

Although a single cable 120 is illustrated in FIGS. 1 to 4, it will be evident that, depending upon the width and size of the shade assembly, one or more stabilizer cables 120 may be mounted in the manner described for larger sized shade assemblies. As the shade 20 is raised and lowered, the extension of the cable 120 through the bottom rail downwardly into anchored relation to the sill rail 14 as described will assist in guiding the shade 20 and maintaining the cells C in vertically aligned relation. At the same time, the upper terminal end of the cable 120 is suspended by the bracket 132 in spaced relation to the uppermost cell C of the shade so that any tension in the cable is distributed across the bracket 132.

Briefly considering the order of assembly of the system, the upper mounting blocks 46 and 69 for the upper drive pulley 34 and guide rollers 35 and 36 may be assembled into opposite ends of the rear half 41 of the motor rail 13, and the lower pulley blocks 96 similarly may be inserted into opposite ends of the sill rail 14 with the guide members 37 and 38 projecting therefrom by spacing the head rail and sill rail apart a distance corresponding to the vertical distance desired for the opening. The cord 30 is then trained over the guide members and drive pulley in the manner described earlier with the free ends 31 and 32 terminating at the end cap 82. In this regard, the cord member is threaded through the fabric of the cell as well as being threaded through the guide openings or bores in opposite end caps 82 of the bottom rail 18. The assembly is completed by placing the front half 40 of the motor rail over the supporting blocks 46 and 69 followed by assembly of the side rails into the hook end portions 65 and 109 as described. The ends 31 and 32 are then tied or looped together, and tensioning of the cord and entire shade is set by tightening the ends 31 and 32 and attaching around the end cap 82 as described earlier. In this operation, there is sufficient flexibility in the cord and shade that they can be drawn away from the side rails 15 and 16 to tighten the locking screws 86 against the cable as well as to level the rail 18 by proper adjustment with respect to the cable or cord 30. If not completely level when tightened, the spring-loaded guide members 37 and 38 are self-compensating for any slight misalignment when the shade assembly or bottom rail is driven against the sill rail and will cause the bottom rail to automatically level when the blind is driven downwardly by the motor drive into engagement with the sill rail. Morever, if the motor should continue to rotate the drive pulley after the movable rail 18 is driven into the sill rail 14, the spring-loaded pulleys 37 and 38 will introduce sufficient slack into the cord 30 to relieve its frictional engagement with the drive pulley and permit the drive pulley essentially to be free-wheeling. Added flexibility is introduced through the use of the flexible coupling 50 between the motor drive shaft and gearing so as to at least partially absorb any stress in raising or lowering the shade.

DETAILED DESCRIPTION OF MODIFIED FORMS OF INVENTION

Figure 15:
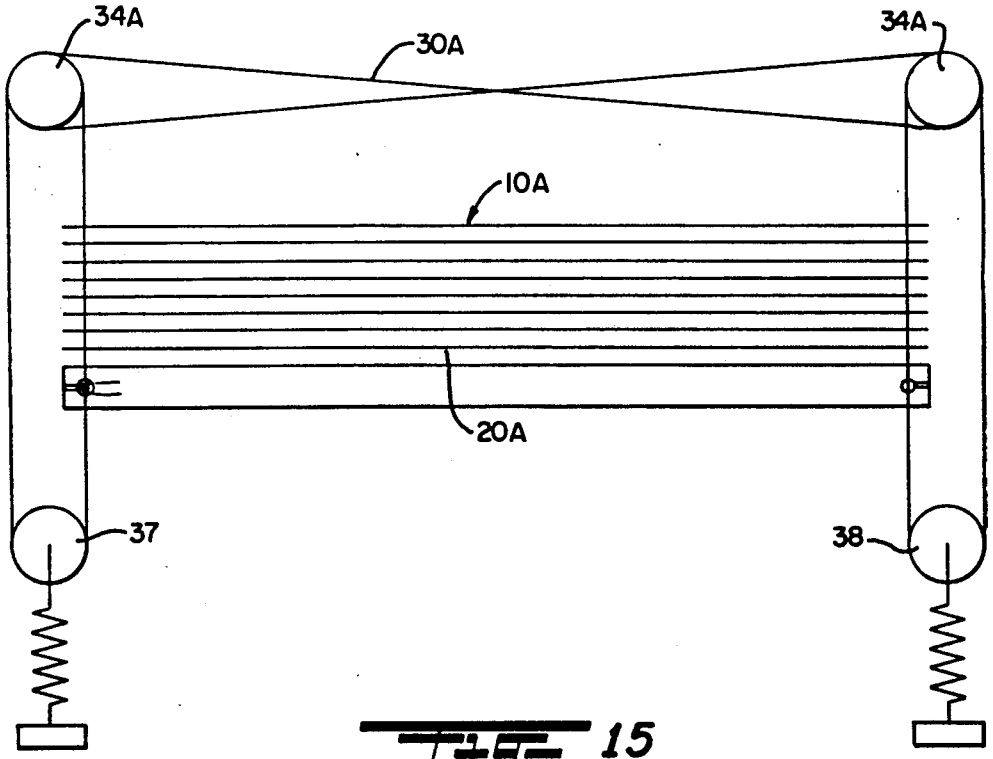
FIG. 15 is a schematic illustration of a modified form of dual motor drive control system for the shade assembly of the present invention.

FIG. 15 schematically illustrates a modified form of shade assembly 10A which employs a motor drive pulley 34A at each end of the head rail in place of the single motor drive pulley 34 of the preferred form shown in FIGS. 1 to 14. In this relation, the motor drive pulley 34A operates in the same manner as that described with reference to the motor drive pulley 34 of the preferred form and is substituted in place of the pulley block 69 and pulleys 35 and 36 of the preferred form. As a result, the cord member 30A extends from innermost groove 34' on the motor drive pulley, as shown in FIG. 12, and is wrapped around the innermost groove of the drive pulley 34A then directed downwardly through the fabric and end cap, around the lower guide member 37 and returned upwardly to be wrapped around the outer groove 34" of the pulley 34A. From the pulley 34A, the cord member 30A is then wrapped around the innermost groove 34' and extended downwardly through the fabric and end cap then around the lower guide 38.

In all other respects, the dual motor drive as well as the shade assembly 10A of FIG. 15 corresponds in construction and operation to that of the preferred form of FIGS. 1 to 14. The dual motor drive has particular application to larger shade assemblies where additional power is needed to raise and lower the shade member 20A. In other words, when the shade size increases to a point where the motor drives a load beyond a recommended limit, the second motor drive assembly can be added in place of the pulley block 69 to provide twice the motor driving force and allow for operation of larger shades. In either the single or dual motor drive, the motors can be controlled and operated either by a wall switch or other automatic sensing and switching control. Typically, the power source is a 12-volt DC power supply which plugs into a standard 110-volt AC outlet and a typical motor is a Sagami Can motor sold by Northwest Shortline of Seattle, Wash. having an output power of 4.5 watts to 6.0 watts.

Figure 16:
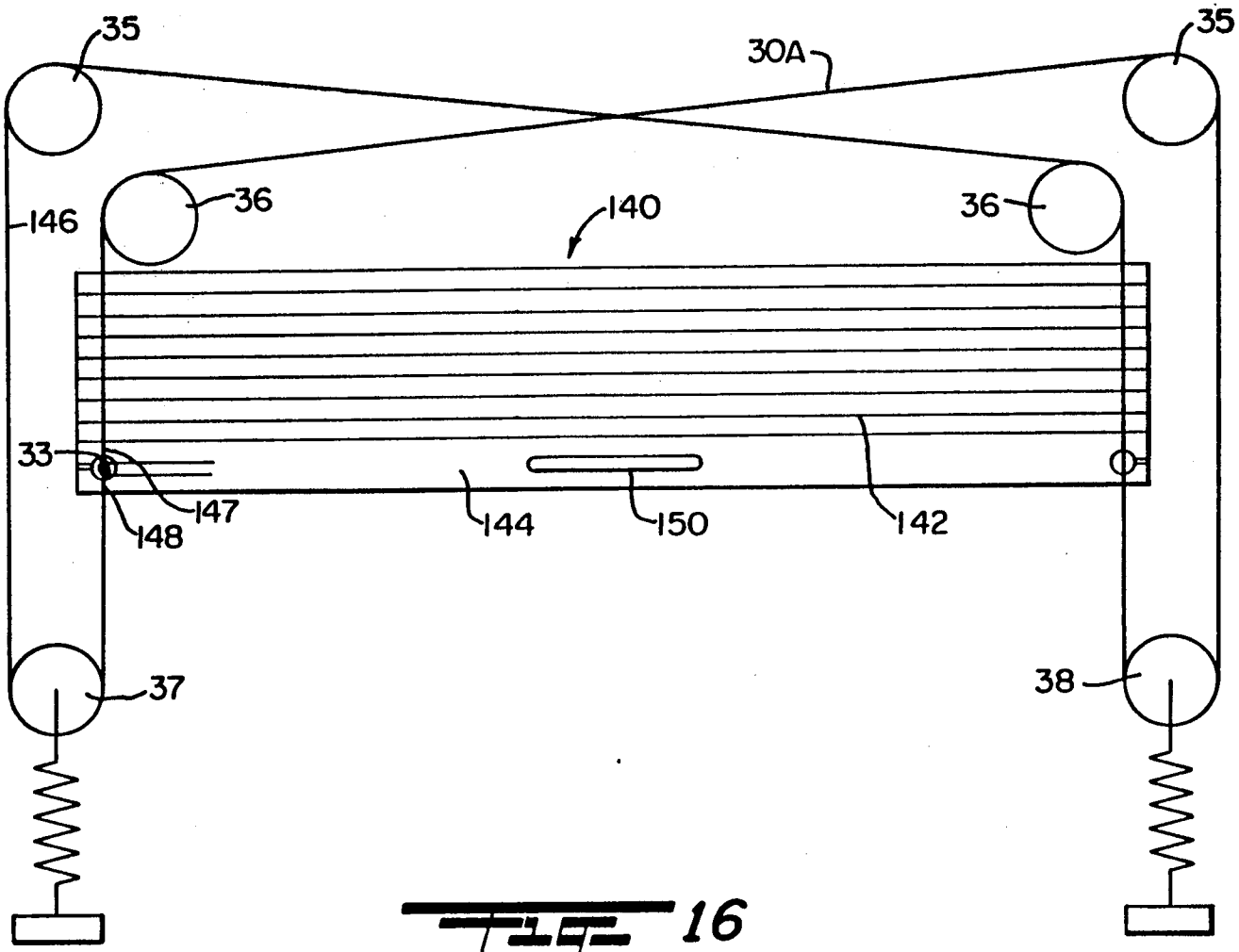
FIG. 16 is a schematic illustration of another modified form of closed loop manual control system for the shade assembly of the present invention.

FIG. 16 illustrates still another modified form of the present invention and specifically resides in a closed loop, manual control system for a shade assembly, broadly represented at 140, and adapted for mounting in an outer, rigid framework which is not shown but which corresponds to the framework 12 of the preferred form of present invention. An accordion-type shade 142 is disposed for slidable advancement within the side channels or rails of the framework 12 and has one end secured to the head rail of the framework 12 and the opposite end secured as shown to a movable bottom rail 144, opposed lateral edges of the movable rail 144 also being inserted within the side channels of the framework.

In order to permit manual operation and control of the shade 142, the motor drive pulley 34 of the preferred form is replaced by a pulley block 69 having pulleys 35 and 36 so that pulleys 35 and 36 are provided at both ends of the head rail of the framework 12, as shown in FIG. 16. In this form of closed loop system, a cord member 146 has free ends 147 and 148 secured together at one end of the movable rail 144, the one end 147 passing downwardly around the lower end of spring-loaded pulley 37, then upwardly around the outside of that pulley to the outside of upper lefthand pulley 35, then angles downwardly through the head rail and is trained over the outside of righthand, inner pulley 36. The cord is then directed downwardly through aligned openings in the shade 142 and movable rail 144 and passed around the inside of guide member 38, then upwardly from the outside of guide member 38 to the outside of the outer righthand pulley 35.

The cord member then angles downwardly through the head rail and around the outside of the inner lefthand pulley 36, then passes downwardly through aligned openings in the shade 142 and terminates in the free end 148 which is tied or otherwise secured together with free end 147 at the end of the movable rail 144. In the manual control system as described, the shade 142 can be drawn upwardly and downwardly between the open and closed position either by grasping of the handle portion 150 or some other part of the movable rail 144. In any event, the rail can be suitably grasped either directly by hand or engaged with a suitable control rod or other implement in the event that the assembly is mounted in a relatively inaccessible location. Furthermore, it will be apparent that various conventional forms of manual control cords or operators can be employed in association with the control system as described in the modified form of FIG. 16.

It is therefore to be understood that while the present invention has been described with particularity relative to the foregoing description of preferred and alternate embodiments, other modifications, changes and additions may be made and will be readily apparent to those of ordinary skill in the art without departing from the spirit and scope of the present invention.

We claim:

1. In a shade assembly for removable installation within an opening in the wall of a building structure wherein the opening is defined by a generally rectangular frame having spaced parallel frame members, and the shade assembly is dimensioned for close-fitting relation within the opening of the building structure with spaced parallel frame portions disposed in closely spaced, confronting relation to each of the respective spaced parallel frame members defining the opening, the improvement comprising:

at least one mounting bracket fastened to one of the confronting surfaces between each of the respective frame portions and frame members, the other of said respective frame portions and frame members having a notched portion alignable with each said mounting bracket, each said mounting bracket including a spring element biased for extension away from the confronting surface to which it is attached toward the other confronting surface for releasable insertion into a notched portion of the other confronting surface, each of said spring elements defined by a leaf spring angled in a direction away from said one confronting surface toward the other confronting surface, said spring elements yieldable in a direction normal to the other confronting surface for movement into and away from a respective notched portion but non-yieldable in a direction parallel to the other confronting surface.

* * * * *